US007633001B2

(12) United States Patent
Terada

(10) Patent No.: US 7,633,001 B2
(45) Date of Patent: Dec. 15, 2009

(54) KEYBOARD-TYPE TONE PLATE PERCUSSION INSTRUMENT

(75) Inventor: Norishige Terada, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/674,918

(22) Filed: Feb. 14, 2007

(65) Prior Publication Data

US 2007/0193434 A1 Aug. 23, 2007

(30) Foreign Application Priority Data

Feb. 22, 2006 (JP) ..... 2006-045371

(51) Int. Cl.
*G10C 3/12* (2006.01)

(52) U.S. Cl. ..... 84/423 R; 84/404

(58) Field of Classification Search ..... 84/423 R, 84/404

See application file for complete search history.

(56) References Cited

U.S. PATENT DOCUMENTS 5,235,892 A * 8/1993 Terada et al. ..... 84/404
5,453,571 A * 9/1995 Adachi et al. ..... 84/658
7,332,669 B2 * 2/2008 Shadd ..... 84/742

FOREIGN PATENT DOCUMENTS

JP 05-127666 5/1993

* cited by examiner

*Primary Examiner*—Jianchun Qin
(74) *Attorney, Agent, or Firm*—DicksteinShapiro LLP

(57) ABSTRACT

A keyboard-type tone plate percussion instrument that permits a player to make an operation to select percussion unit's striking a tone plate with or without intervention of a displacement member between percussion units and tone plates, making it possible to change, with a simple construction, tone color produced by a struck tone plate. In response to key depression, a corresponding percussion unit (24) is driven. The percussion unit directly strikes a corresponding tone plate when a displacement member (78, 178, 278, 378), which is different in material and hardness from percussion units, is extracted from between keys and the percussion units, but indirectly strikes the tone plate via the displacement member when the displacement member is interposed therebetween.

4 Claims, 6 Drawing Sheets

KEYBOARD-TYPE TONE PLATE PERCUSSION INSTRUMENT

BACKGROUND OF THE INVENTION

1. Field of the Invention

The present invention relates to a keyboard-type tone plate percussion instrument in which a musical tone is sounded by a tone plate being struck by a percussion unit in response to a key depression operation.

2. Description of the Related Art

Conventionally, percussion instruments such as keyboard-type tone plate percussion instruments have been known, in which percussion units such as hammer actions are provided so as to correspond to respective ones of sounding members such as tone plates, and a musical tone of a specific tone pitch is generated when a corresponding sounding member is struck by a corresponding percussion unit in response to a key depression operation. In these percussion instruments for producing a musical tone by a struck sounding member, it is also known to make tone color variable (Japanese Laid-open Patent Publication No. H05-127666).

In such percussion instruments, each hammer is provided with a plurality of heads having different hardness. These hammer heads are juxtaposed in a direction perpendicular to the longitudinal axis of a corresponding tone rod, and each hammer is made movable relative to the tone rod. With a hammer motion, a desired one of the hammer heads is selected for actually striking the tone rod. A tone color sounded from the tone rod struck by the hammer varies depending on which one of the hammer heads is selected.

With the percussion instrument disclosed in Japanese Laid-open Patent Publication No. 5-127666, however, a plurality of small-sized heads must be embedded in each hammer that is narrow in width. Thus, the hammer is complicated in construction and difficult to fabricate. To ensure an appropriate hammer head selection, the respective heads must be embedded in the hammer with high accuracy and the hammer must be moved relative to the tone rod with accuracy.

In some acoustic pianos, there are provided muffler felts each of which is disposed for insertion and extraction into and from between a corresponding pair of string and hammer. When a key is depressed with a corresponding muffler felt interposed between the string and the hammer, the string is struck by the hammer via the muffler felt. In these pianos, however, the muffler felts are made of the same material as that of hammer felts for the hammers. In other words, the muffler felts are provided with the intention of solely reducing sound volume but without the intention of changing tone colors.

SUMMARY OF THE INVENTION

An object of the present invention is to provide a keyboard-type tone plate percussion instrument that permits a player to make an operation to select percussion unit's striking a tone plate with or without intervention of a displacement member between percussion units and tone plates, thereby making it possible to change, with a simple construction, tone color produced by a struck tone plate.

To attain the object, according to the present invention, there is provided a keyboard-type tone plate percussion instrument comprising a plurality of keys that constitute a keyboard, a plurality of tone plates each of which sounds a musical tone of a specific tone pitch when struck, a plurality of percussion units (24) that are disposed so as to correspond to respective ones of the plurality of keys and the plurality of tone plates and are each driven in response to a corresponding key depression operation, a displacement member (78, 178, 278, 378) disposed for displacement between an intervening position where it is interposed between the tone plates and the percussion units and a non-intervening position where it is extracted from between the tone plates and the percussion units, the displacement member being different in material and hardness from the percussion units, and an operating device (72, 85) for being operated to displace the displacement member, wherein each percussion unit directly strikes a corresponding tone plate when driven with the displacement member extracted from between the tone plates and the percussion units, and indirectly strikes the corresponding tone plate via the displacement member when driven with the displacement member interposed between the tone plates and the percussion units.

It should be noted that reference numerals in parentheses in the above description simply indicate examples of structural elements of the percussion instrument and are not intended to limit the construction thereof or the like (ditto in the following).

According to the present invention, a player is permitted to make an operation to select percussion unit's striking a tone plate with or without the intervention of the displacement member between the percussion units and the tone plates, whereby a striking tone color can be changed with a simple construction.

Preferably, the displacement member is movable toward and away from between the tone plates and the percussion units for movement between the intervening position and the non-intervening position thereof, the displacement member (278, 378) being formed into a plate having a thickness thereof varying in a direction along which the displacement member is moved, and the striking tone color varies depending on a thickness of that portion of the displacement member which is interposed between the tone plates and the percussion units when the corresponding tone plate is struck indirectly by the percussion unit via the displacement member.

With this preferred embodiment, it is possible to attain a variety of striking tone colors by changing the moving position of the displacement member to thereby change the thickness of that portion of the displacement member which is interposed between the tone plates and the percussion units.

Preferably, the operating device includes an operation lever that is manually operable, and a pivot arm that is coupled to the operation lever and supports the displacement member. In this case, the player can cause the displacement member to be interposed between the tone plates and the percussion units by operating the operation lever, thereby changing the tone color.

Alternatively, the operating device includes a pedal for being stepped on and a pivot arm that is coupled to the pedal and supports the displacement member. In this case, the player can cause the displacement member to be interposed between the tone plates and the percussion units by stepping on the pedal, thereby changing the tone color.

Preferably, the operating device includes a pedal casing for accommodating the pedal, the pedal casing having an engaging portion for maintaining the pedal in a stepped on state. In this case, even if the pedal is released from being stepped on, it is possible to maintain the state where the displacement member is interposed between the tone plates and the percussion units.

Preferably, the displacement member is softer in material and lower in hardness than the percussion units. In this case, soft tone color can be realized by causing the displacement member to be interposed between the tone plates and the percussion units.

Preferably, the displacement member includes a proximal end thereof coupled to the operating device and a body portion thereof extending from the proximal end toward the percussion units. In this case, when operated, the operating device can cause the displacement member to be interposed between the tone plates and the percussion units with reliability.

With this preferred embodiment, it is possible to attain a variety of striking tone colors by changing the moving position of the displacement member to thereby change the thickness of that portion of the displacement member which is interposed between the tone plates and the percussion units.

Preferably, the displacement member includes a proximal end thereof coupled to the operating device and a body portion thereof extending from the proximal end toward the percussion units. In this case, when operated, the operating device can cause the displacement member to be interposed between the tone plates and the percussion units with reliability.

More Preferably, the body portion of the displacement member is divided by cutting into pivotally movable bodies corresponding to respective ones of the percussion units. In this case, the displacement member can be interposed between the tone plates and the percussion units with a small operating force, utilizing a key depression force of the percussion unit concerned.

Preferably, the body portion of the displacement member has a thickness thereof decreasing stepwise or gradually decreasing in a direction from the proximal end toward the percussion units. In this case, the tone color varies according to an amount of displacement of the displacement member, and therefore, the tone color can be changed variously by adjusting the amount of displacement.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
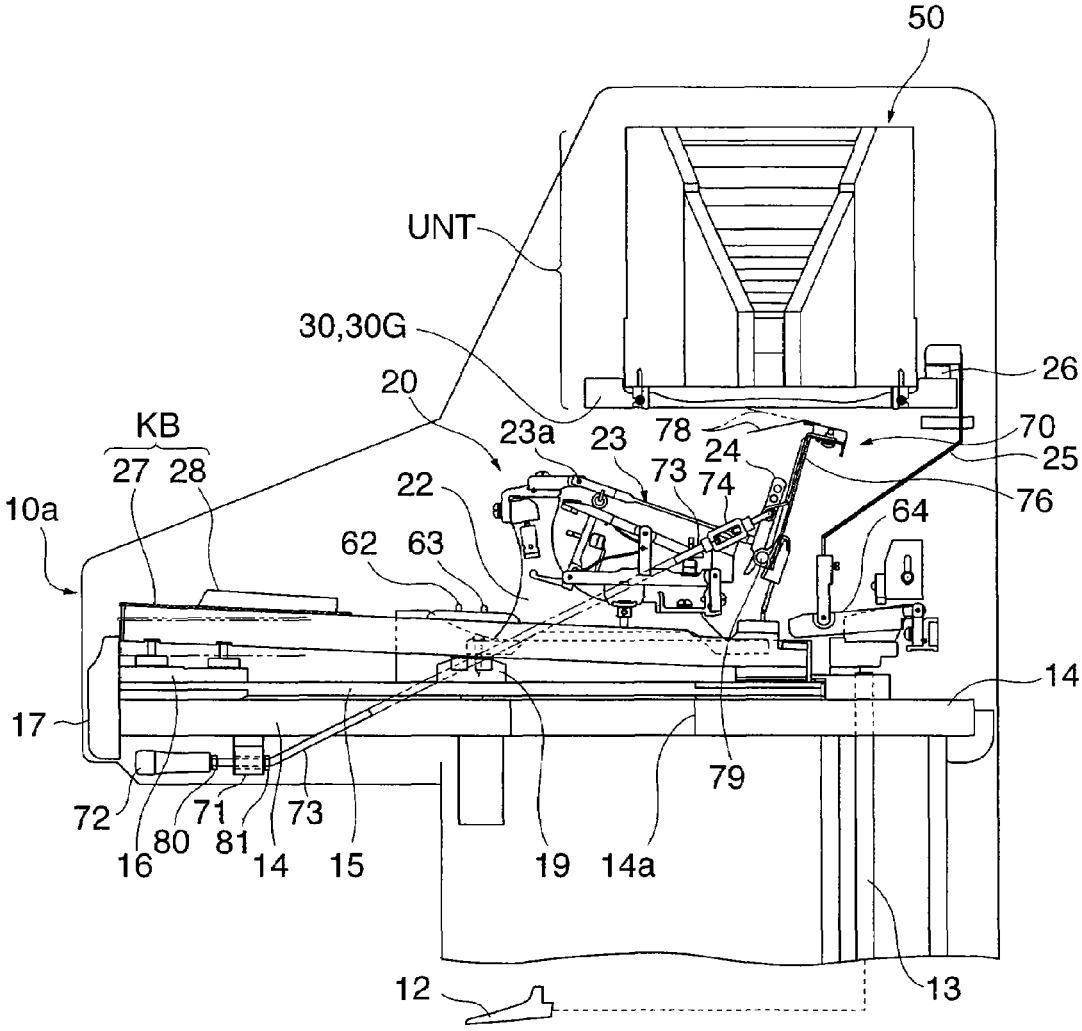
FIG. 1 is a section view showing the internal construction of an upper half of a keyboard instrument, which is a keyboard-type tone plate percussion instrument according to a first embodiment of the present invention.

FIG. 1 is a section view showing the internal construction of an upper half of a keyboard instrument according to a first embodiment of the present invention. Roughly speaking, this keyboard instrument 10 is configured as a keyboard-type tone plate percussion instrument, which is analogous in appearance to an upright piano, but does not include any strings. Instead, the keyboard instrument 10 includes tone plates that are similar to those of a celesta and provided in an upper half 10*a* of the keyboard instrument 10. When struck, each tone plate vibrates and generates a musical tone. The keyboard instrument 10 includes a resonance box that causes a musical tone generated by a corresponding tone plate to resonate therein. As mechanisms for striking the tone plates, there are provided mechanisms similar to action mechanisms for a grand piano but not for an upright piano. In the following, the side of the keyboard instrument 10 toward a player will be referred to as the front side, and the left and right directions are determined in reference to the player.

As shown in FIG. 1, a key frame 15 is disposed on a keybed 14 which is provided in a lower part of the upper half 10*a* of the keyboard instrument 10, and a front rail 16 is formed on the front side of the key frame 15. The key frame 15 is provided with a balance rail 19 that supports a plurality of white keys 27 and a plurality of black keys 28 of a keyboard KB for vertical pivotal motion (seesaw motion) around respective ones of balance pins 62, 63 that are provided in the balance rail 19. A front portion of the front rail 16 is covered by a keyslip 17 over the entire width of the keys.

Action mechanisms 20 are disposed through action brackets 22 on an upper portion of a rear half of the key frame 15. The action brackets 22 and the action mechanisms 20 are arranged to correspond to respective ones of the keys 27, 28. The action mechanisms 20 are the same in construction as those of a grand piano. A tone generator unit UNT, including a wood resonance box 50 and a tone plate group 30G comprised of a plurality of tone plates 30, is disposed above the action mechanisms 20. The tone plates 30 are provided to correspond to respective ones of the keys 27, 28. When any one of the keys 27, 28 is depressed, a corresponding hammer 23 is pivoted upward and then a hammer felt 24 strikes a corresponding tone plate 30, which vibrates and generates a musical tone that resonates in the resonance box 50. The keybed 14 disposed below the action mechanisms 20 is formed with sound output ports 14*a*.

A damper pedal 12 is provided in a lower part of the keyboard instrument 10. A plurality of pivotal members 64 are provided above rear ends of the keys 27, 28 so as to correspond to respective ones of the keys 27, 28, and damper felts 26 are provided on respective ones of damper wires 25 extending from the pivotal members 64. A pedal coupling rod 13 is coupled to the damper pedal 12. When the damper pedal 12 is stepped on, all the damper felts 26 are lifted up by means of the pedal coupling rod 13 and all the damper wires 25. When the damper pedal 12 is not stepped on, each of the damper felts 26 is in contact with the upper face of a rear end of the corresponding tone plate 30. When any one of the keys is depressed, the corresponding damper felt 26 is caused, via the damper wire 25, to be separated apart from the corresponding tone plate 30.

A tone color changing mechanism 70 is provided in the upper half 10*a* of the keyboard instrument 10. As will be described in detail later, the tone color changing mechanism 70 is mainly comprised of an operation lever 72, a reciprocating rod 73, a pivot arm 76, an intervening member 78, and the like.

Figure 2:
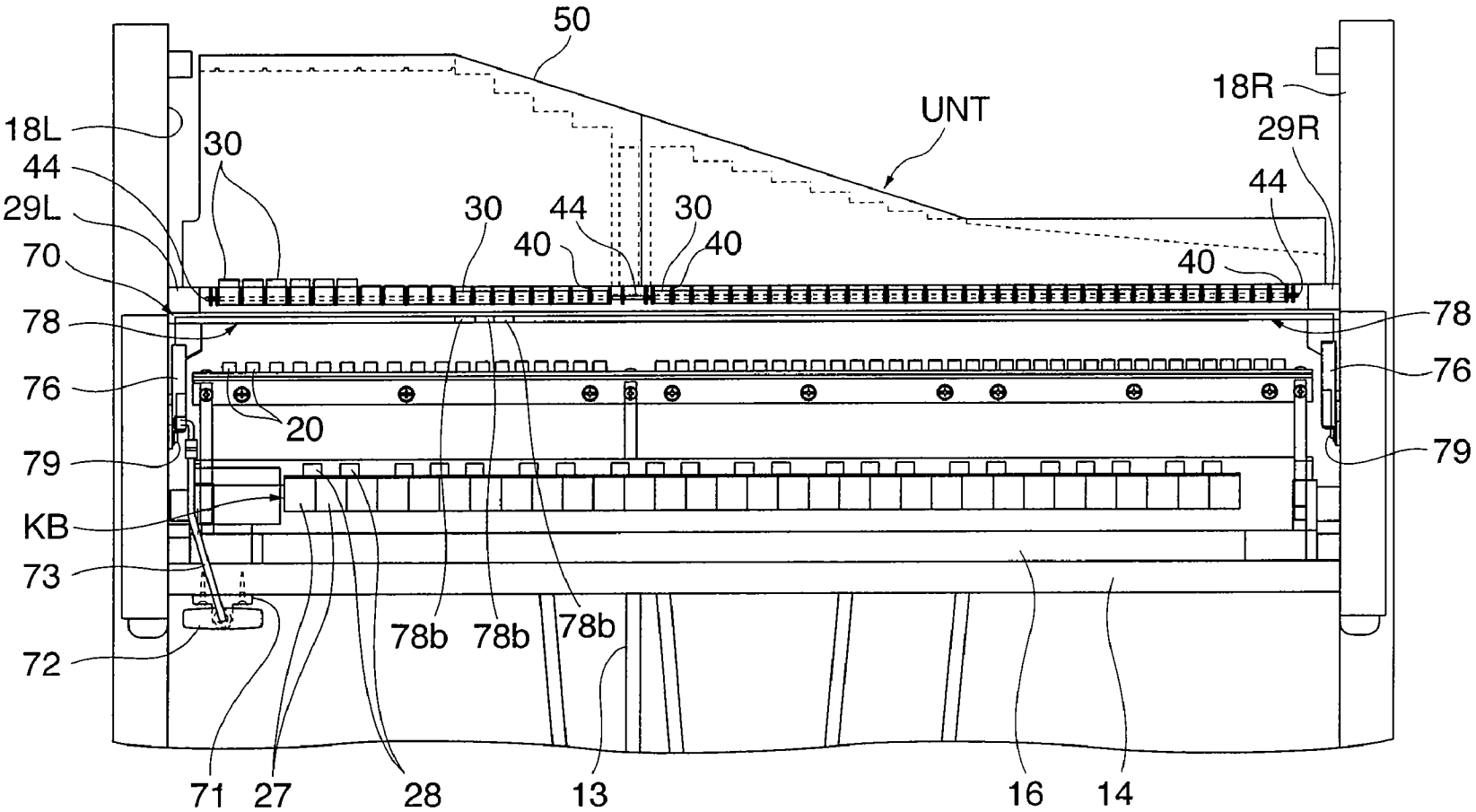
FIG. 2 is a front view showing the internal construction of the upper half of the instrument.
Figure 3:
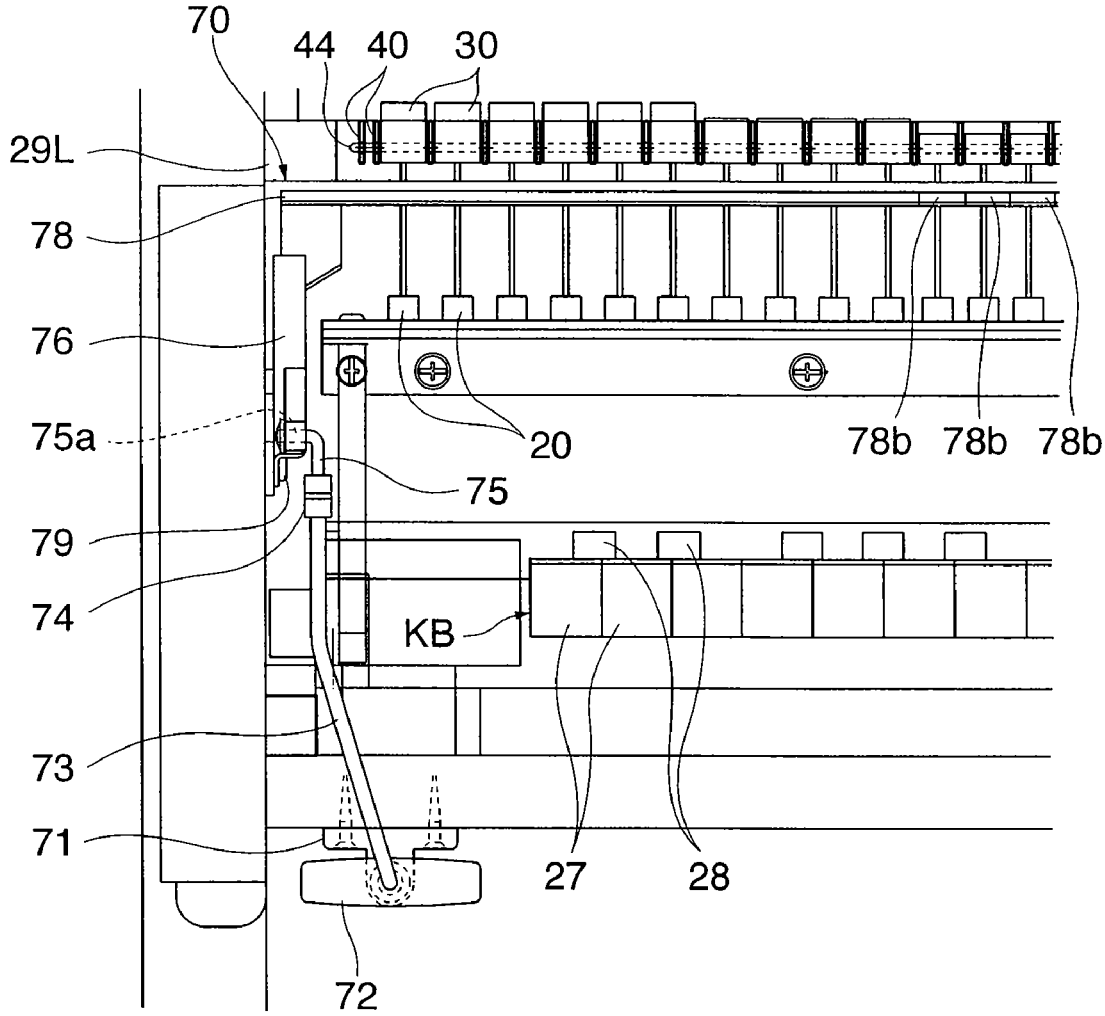
FIG. 3 is a fragmentary enlarged front view showing a left side part of the upper half of the instrument.
Figure 4:
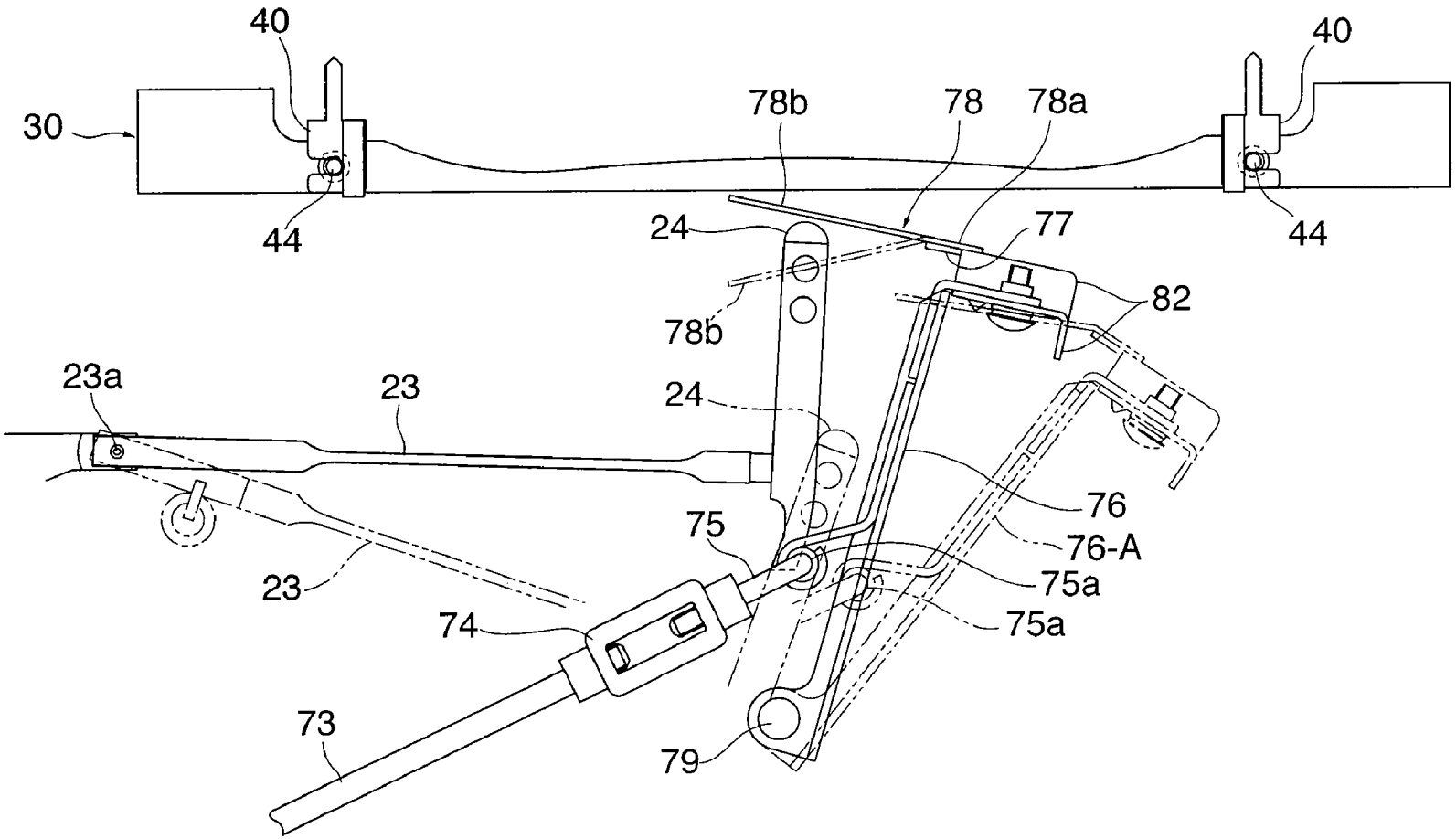
FIG. 4 is a left side view showing an essential part of a tone color changing mechanism of the instrument.

FIG. 2 is a front view showing the internal construction of the upper half 10*a* of the keyboard instrument 10, and FIG. 3 is a fragmentary enlarged front view showing a left side part of the upper half 10*a* of the keyboard instrument 10. FIG. 4 is a left side view showing an essential part of the tone color changing mechanism 70.

As shown in FIG. 2, supporting portions 29L, 29R are fixed to inner sides of side plates 18L, 18R that constitute right and left sides of the keyboard instrument 10. The resonance box 50 has its left and right sides fixed to the support portions 29L, 29R by means of screws, not shown, whereby the tone generator unit UNT is received in the upper half 10*a* of the keyboard instrument 10.

The tone plate group 30G is comprised of tone plates 30 that are equal in number to the keys. These tone plates 30 extend in their longitudinal direction corresponding to the front-to-rear direction of the keyboard instrument 10 and are arranged parallel to one another in the left-to-right direction of the keyboard instrument 10. The tone plates 30 are formed into rectangle in section but are different in shape such as the entire length or the like from one another. Thus, each tone plate 30 vibrates when struck by the corresponding percussion unit 24 and generates a musical tone of a specific tone pitch. Tone plates 30 neighboring in specific tone pitch are arranged adjacent to each other.

As shown in FIG. 4, each tone plate 30 has longitudinally opposite end portions thereof formed with supporting holes through which a coupling cord 44 (also refer to FIG. 2) extends. A number of fasteners 40 having engaging portions with which the coupling cord 44 is engaged are mounted to a lower surface of the resonance box 50. As shown in FIG. 2, the tone plates 30 are mounted for vibration to the resonance box 50 through the coupling cord 44 and the fasteners 40 so as to be suspended from the resonance box 50.

As shown in FIGS. 1 to 3, a rod support 71 is fixed to a lower surface of a front left end portion of the keybed 14. A reciprocating rod 73 is made of a rigid metal, and has a front end portion thereof supported by the rod support 71. An operation lever 72 that is manually operable is mounted to a front end of the reciprocating rod 73. Further, as shown in FIG. 1, stoppers 80, 81 are fixed on the reciprocating rod 73 at locations forward and rearward of the rod support 71, respectively. When the reciprocating rod 73 is caused to move forward and rearward, the stoppers 80, 81 are made in contact with the rod support 71 to define the frontmost position and the rearmost position of the reciprocating rod 73. The reciprocating rod 73 and the rod support 71 are designed to produce friction therebetween. Thus, the position of the reciprocating rod 73 can be maintained by having the stoppers 80, 81 in contact with the rod support 71. Alternatively, locking mechanisms for holding the reciprocating rod 73 in the frontmost and rearmost positions may be provided.

The reciprocating rod 73 is bent upward at a location immediately behind the rod support 71 and upwardly and rearwardly extends to the vicinity of the percussion units 24 while forming a gentle V-shape as viewed in side view (refer to FIG. 1). As shown in FIG. 3, the reciprocating rod 73 has a rear end thereof to which an arm supporting rod 75 is coupled through a length adjuster 74. By operating the operation lever 72 in the front-to-rear direction, the reciprocating rod 73 is slidably moved relative to the rod support 71 in the front-to-rear direction. As a result, the reciprocating rod 73, the length adjuster 74, and the arm supporting rod 75 are reciprocated together in the front-to-rear direction. With the length adjuster 74, the fixed position of the arm supporting rod 75 relative to the reciprocating rod 73 can be adjusted in the longitudinal direction.

As shown in FIG. 2, pivot shafts 79 are provided on the inner side of the side plates 18L, 18R, and arms 76 are provided so as to be pivotable around the pivot shafts 79, respectively (also refer to FIG. 4). As shown in FIG. 4, a coupling member 82 made of metal, resin, or the like is disposed between the left and right arms 76 so that these arms 76 are pivoted together around the pivot shafts 79 in an interlocking manner through the coupling member 82. A supporting plate 77 made of metal, resin, or the like is disposed at a location on the upper front side of the coupling member 82, so as to extend between the left and right arms 76.

Further, an intervening member 78 which is formed into a thin plate shape and uniform in thickness is provided on the supporting plate 77. The intervening member 78 is fixed at its proximal end 78*a* to an upper surface of the supporting plate 77 by adhesive or the like. The intervening member 78 has a body portion thereof forwardly extending from the proximal end 78*a*. The forwardly extending portion of the intervening member 78 is divided by cutting longitudinally into pivotally movable bodies 78*b* corresponding to respective ones of the percussion units 24 (also refer to FIGS. 2 and 3). Under natural conditions, these pivotally movable bodies 78*b* extend slightly downward, but are individually pivotable upward with light force.

As shown in FIG. 3, the arm supporting rod 75 has a rear portion thereof bent leftward to form a shaft portion 75*a* that pivotably supports the left arm 76. When the arm supporting rod 75 is moved in the front-to-rear direction, the left arm 76 is urged in the front-to-rear direction so as to be pivoted around the pivot shaft 79 in the front-to-rear direction together with the right arm 76. As a result, the intervening member 78 is displaced in the front-to-rear direction.

As shown in FIG. 4, when the arm 76 is in the rearmost position (shown by reference numeral 76-A) in a pivotable range, the pivotally movable body 78*b* of the intervening member 78 is not interposed between the percussion unit 24 and the tone plate 30 concerned. Thus, when the corresponding key is depressed, the percussion unit 24 directly strikes the tone plate 30. On the other hand, when the arm 76 is in the frontmost position in the pivotable range, the pivotally movable body 78*b* of the intervening member 78 is interposed between the percussion unit 24 and the tone plate 30. In that case, therefore, when the percussion unit 24 is driven in response to a key depression operation, the percussion unit 24 indirectly strikes the tone plate 30 through the pivotally movable body 78*b*. Specifically, the percussion unit 24 corresponding to the depressed key is brought in contact with the corresponding pivotally movable body 78*b* pivoted upward so as to be interposed between the percussion unit 24 and the tone plate 30, and then strikes the tone plate 30.

At least that portion of each percussion unit 24 which strikes the tone plate 30 is made of a resin-based material or a deer horn-based material. When a tone plate 30 is directly struck by a corresponding percussion unit, therefore, the resultant musical tone has hard tone color similar to that of a general glockenspiel. On the other hand, at least that portion of the intervening member 78 which is interposed between the percussion unit 24 and the tone plate 30 when the tone plate is struck is made of a felt material which is different from the material of the percussion unit 24 and has lower hardness. Thus, when a tone plate 30 is struck indirectly through the intervening member 78, the resultant musical tone has soft tone color. As a result, it is possible to change the sounded tone color of the tone plate 30 depending on whether or not the intervening member 78 is interposed between the percussion unit 24 and the tone plate 30.

According to the present embodiment, the intervening member 78 different in material and hardness from the percussion units 24 can be operated for reciprocal motion toward and away from between the percussion units 24 and the tone plates 30 so as to be displaced between the intervening position and the non-intervening position, making it possible to select whether a respective tone plate is struck by a corresponding percussion unit 24 directly or indirectly. As a result, the striking tone color can be changed with simple construction, making it possible to realize a rich performance expression.

Second Embodiment

Unlike the first embodiment where the arms 76 are driven by a manual operation by hand, they are driven by a pedal operation in this embodiment.

Figure 5:
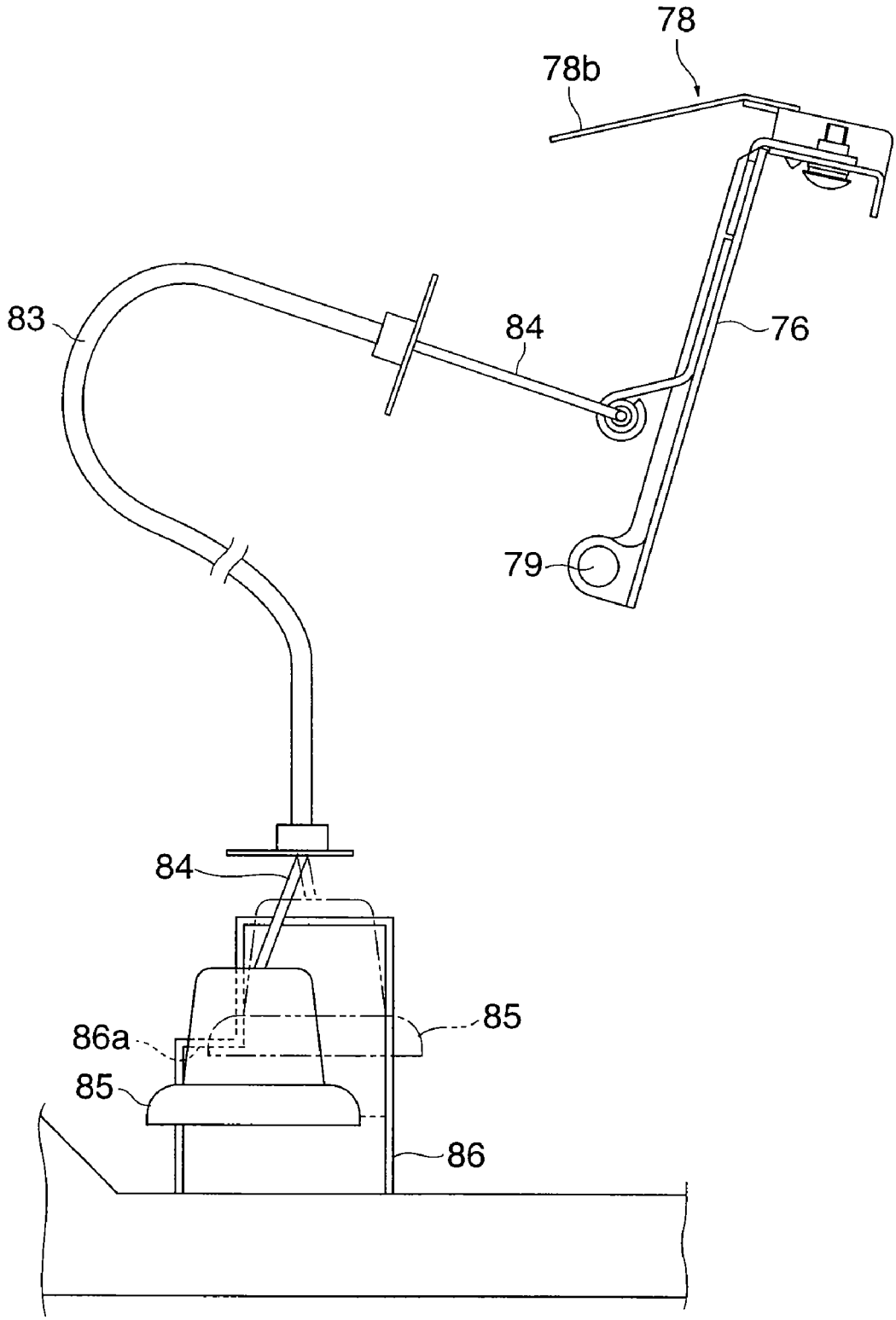
FIG. 5 is a left side view schematically showing the construction of a tone color changing mechanism of a percussion instrument according to a second embodiment of the present invention.

FIG. 5 is a left side view schematically showing the construction of a tone color changing mechanism according to the second embodiment. As shown in FIG. 5, the arms 76 and the intervening member 78 are similar in construction to those in the first embodiment. There is provided a wire 84 having one end thereof coupled to the arm 76 concerned. The wire 84 extends downward, passing through a wire casing 83 that is fixed at a predetermined position in the keyboard instrument 10. In the keyboard instrument 10, a tone color change pedal 85 for driving the arm 76 is provided in the vicinity of the damper pedal 12, and the other end of the wire 84 is coupled to the tone color change pedal 85.

In the pedal casing 86, the tone color change pedal 85 is always urged upward by means of spring or the like, not shown. The tone color change pedal 85 is moved downward when stepped on by foot, and is returned upward when the foot is released from the pedal 85. When the tone color change pedal 85 is urged leftward after it is depressed down to reach its lowest position, an engaging portion, not shown, of the pedal is made in engagement with a stepped portion 86*a* of the pedal casing 86, whereby the tone color change pedal 85 is retained in the depressed state.

According to the above arrangement, in an initial state where the tone color change pedal 85 is not stepped on, the arms 76 are located at their rearmost position, and the pivotally movable bodies 78*b* are not interposed between the percussion units 24 and the tone plates 30. On the other hand, when the tone color change pedal 85 is depressed, the arms 76 are pulled by the wire 84 and pivoted forward around the pivot shafts 79 to reach the frontmost position. As a result, the pivotally movable bodies 78*b* are interposed between the percussion units 24 and the tone plates 30.

When wishing to change the tone color to generate soft tone color, the player depresses down the tone color change pedal 85 to the lower end position before key depression. Further more, when wishing to retain the state of the tone color change pedal 85 being in the lowest position, the player causes the tone color change pedal 85 to move leftward by foot so that the pedal is made in engagement with the stepped portion 86*a* of the pedal casing 86. As a result, the tone color change pedal 85 is kept retained in the lowest position, and therefore, the tone color changed state is retained even the player's foot is released from the tone color change pedal 85. Subsequently, when the player causes the tone color change pedal 85 to move rightward to thereby release the engagement between the tone color change pedal 85 and the stepped portion 86*a* of the pedal casing 86 and then releases the foot from the pedal, the arms 76 are restored to their initial position whereby the tone color is restored.

According to the present embodiment, effects similar to those attained by the first embodiment can be attained. In addition, the tone color changing operation can be carried out by foot. This makes it easy to change the tone color in a desired performance part during the performance, whereby a rich performance expression can be attained.

In the first and second embodiments, the plate-like intervening member 78 that is uniform in thickness is used as a member interposed between the percussion units 24 and the tone plates 30. As described below, this is not limitative. Further, the material of the intervening member is not limited to a felt material.

Figure 6A:
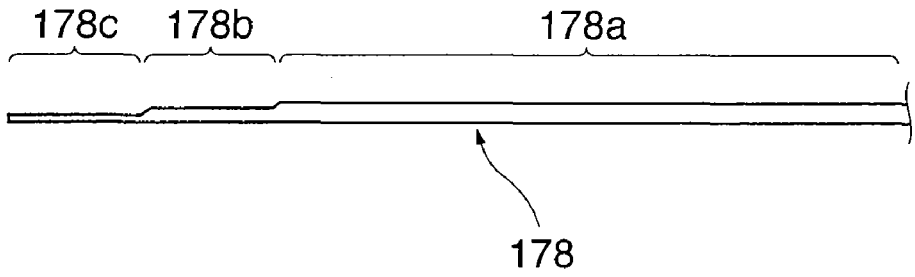
FIG. 6A is a view showing a modification of an intervening member that is interposed between percussion units and tone plates.
Figure 6B:
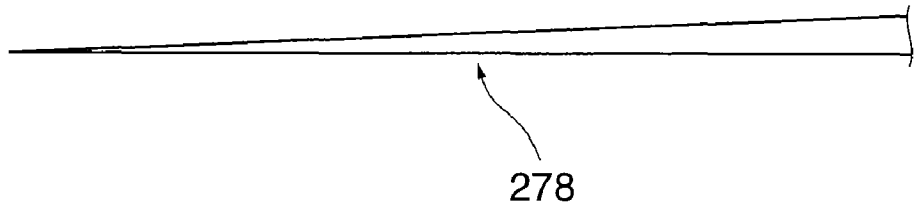
FIG. 6B is a view showing another modification of the intervening member.
Figure 6C:
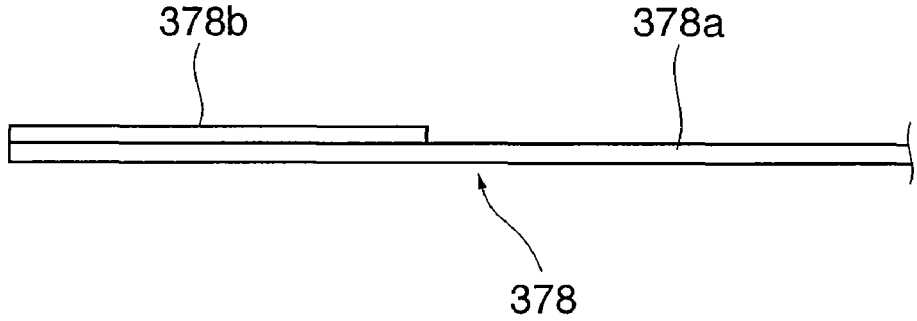
FIG. 6C is a view showing still another modification of the intervening member.

FIGS. 6A to 6C are views showing modifications of the intervening member interposed between the percussion units 24 and the tone plates 30. In the modification shown in FIG. 6A, an intervening member 178 is made of a material similar to that of the intervening member 78, and has portions thereof corresponding to respective ones of the pivotally movable bodies 78*b* of the intervening member 78 and having a thickness varying in stages (stepwise), for example, in three stages. More specifically, the intervening member 178 has first, second, and third sections 178*a* to 178*c* that are made thinner in the mentioned order. As a driving mechanism of the intervening member 178, the tone color change pedal 85 may be used, which has been described in the second embodiment. In the course of the depression stroke of the tone color change pedal 85, the arms 76 can be retained at a desired position in the front-to-rear direction in accordance with the player's intention by not further stepping on the tone color change pedal 85 by foot after the pedal 85 is stepped on to a desired depth.

More specifically, by adjusting the depression depth of the tone color change pedal 85, the player can make an operation for selecting a desired one of the first to third sections 178*a* to 178*c* that is to be interposed between the percussion units 24 and the tone plates 30. When any one of the percussion units 24 indirectly strikes the corresponding tone plate 30 through the intervening member 178, the tone color is differentiated in three stages due to the thickness difference between the first to third sections 178*a* to 178*c*. When the first section 178*a*, which is the thickest portion of the intervening member 178, is interposed between the percussion unit 24 and the tone plate 30, the softest tone color is produced.

Instead of differentiating the thickness of the intervening member stepwise, an intervening member 278 is formed to have a gradually thinner thickness toward the front side of an intervening member 278, as shown in FIG. 6B. In the case of using the intervening member 278, the tone color is gradually differentiated as a function of the depression depth of the tone color change pedal 85, making it possible to realize a much more fine variable tone color control.

As described above, with the intervening members shown in FIGS. 6A and 6B, it is possible to realize a variety of striking tone color changes by a reciprocal motion of the intervening member having the thickness varying along the direction of the reciprocal motion.

In the first and second embodiments, the percussion unit 24 is made of a resin or the like, and the intervening member 78 is made of a felt material that has a lower hardness than the material of the percussion units 24. Alternatively, from the viewpoint of changing the tone color, it is enough for the percussion unit and the intervening member to be different in material and hardness from each other. Thus, the materials for them may be selected in various manners, and the relationship between the hardness of them may be reversed as compared to that of the above embodiments. Specifically, that portion of the percussion unit 24 which strikes the tone plate 30 may be made of a soft material such as felt, and the intervening member may be made of a material that is harder than the material of the percussion unit 24.

In that case, as shown by way of example in FIG. 6C, an intervening member 378 may be comprised of a pivotally movable body 378*a* and a plate 378*b* disposed on an upper surface of a tip end portion of the pivotally movable body 378*a*. The pivotally movable body 378*a* is made of steel or the like and formed into a plate spring. The plate 378*b* may be made of a hard material such as brass and disposed at a location where it is made in contact with the tone plates 30. With this construction, conversely with the first and second embodiments, soft tone color is produced when the tone plate 30 is struck directly, whereas hard tone color is produced when the tone plate is struck indirectly. It should be noted that the material of a softer one, among the percussion unit 24 and the intervening member, is not limited to felt, but may be a resilient member made of rubber or the like.

The arrangement for displacing the intervening member that is interposed between or extracted from between the percussion units 24 and the tone plates 30 is not limitative to the above-mentioned arrangement. Specifically, the arrangement is not limited to one utilizing the pivotal displacement of the arms 76, but may be one utilizing a slide motion of the intervening member. Alternatively, the intervening member wound into a roll may be wound and unwound in such a manner that at least a portion of the roll is interposed between or extracted from between the percussion units 24 and the tone plates 30.

In the first and second embodiments, the intervening member 78 has the pivotally movable bodies 78*b* thereof formed so as to correspond to respective ones of the percussion units 24, but the present invention is not limited thereto. Alternatively, there may be provided another type of pivotally movable body 78*b* that is formed to be long in the left-to-right direction so as to correspond to a plurality of tone plates 30 or all the tone plates 30 in an arrangement where the pivotally movable body 78*b* is located to very close to the tone plates 30 when it is in the frontmost position. In such an arrangement, the pivotally movable body 78*b* may be wound into a roll so that it may be wound and unwound for displacement between the intervening position and the non-intervening position.

It should be noted that the present invention is suitably applied to a glockenspiel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A keyboard-type tone plate percussion instrument, comprising:

a plurality of keys that constitute a keyboard;

a plurality of tone plates each of which sounds a musical tone of a specific tone pitch when struck;

a plurality of percussion units that are disposed so as to correspond to respective ones of the plurality of keys and the plurality of tone plates and are each driven in response to a corresponding key depression operation;

a displacement member alters a tone color of a tone plate disposed for displacement between an intervening position where it is interposed between the tone plates and the percussion units and a non-intervening position where it is extracted from between the tone plates and the percussion units, the displacement member being different in material and hardness from the percussion units; and an operating device for being operated to displace the displacement member, wherein each percussion unit directly strikes a corresponding tone plate when driven with the displacement member extracted from between the tone plates and the percussion units, and indirectly strikes the corresponding tone plate via the displacement member thereby altering the tone color of the struck tone plate when driven with the displacement member interposed between the tone plates and the percussion units, wherein said displacement member is movable between the tone plates and the percussion units for movement between the intervening position and the non-intervening position thereof, wherein the displacement member is formed into a plate having a thickness thereof varying in a direction along which the displacement member is moved, and wherein the striking tone color varies depending on a thickness of that portion of the displacement member which is interposed between the tone plates and the percussion units when the corresponding tone plate is struck indirectly by the percussion unit via the displacement member.

2. A keyboard-type tone plate percussion instrument, comprising:

a plurality of keys that constitute a keyboard;

a plurality of tone plates each of which sounds a musical tone of a specific tone pitch when struck;

a plurality of percussion units that are disposed so as to correspond to respective ones of the plurality of keys and the plurality of tone plates and are each driven in response to a corresponding key depression operation;

a displacement member alters a tone color of a tone plate disposed for displacement between an intervening position where it is interposed between the tone plates and the percussion units and a non-intervening position where it is extracted from between the tone plates and the percussion units, the displacement member being different in material and hardness from the percussion units; and an operating device for being operated to displace the displacement member, wherein each percussion unit directly strikes a corresponding tone plate when driven with the displacement member extracted from between the tone plates and the percussion units, and indirectly strikes the corresponding tone plate via the displacement member thereby altering the tone color of the struck tone plate when driven with the displacement member interposed between the tone plates and the percussion units, wherein said displacement member includes a proximal end thereof coupled to said operating device and a body portion thereof extending from said proximal end toward said percussion units, wherein the body portion of said displacement member is divided to form pivotally movable bodies corresponding to respective ones of said percussion units.

3. A keyboard-type tone plate percussion instrument, comprising:

a plurality of keys that constitute a keyboard;

a plurality of tone plates each of which sounds a musical tone of a specific tone pitch when struck;

a plurality of percussion units that are disposed so as to correspond to respective ones of the plurality of keys and the plurality of tone plates and are each driven in response to a corresponding key depression operation;

a displacement member alters a tone color of a tone plate disposed for displacement between an intervening position where it is interposed between the tone plates and the percussion units and a non-intervening position where it is extracted from between the tone plates and the percussion units, the displacement member being different in material and hardness from the percussion units; and an operating device for being operated to displace the displacement member, wherein each percussion unit directly strikes a corresponding tone plate when driven with the displacement member extracted from between the lone plates and the percussion units, and indirectly strikes the corresponding tone plate via the displacement member thereby altering the tone color of the struck tone plate when driven with the displacement member interposed between the tone plates and the percussion units, wherein said displacement member includes a proximal end thereof coupled to said operating device and a body portion thereof extending from said proximal end toward said percussion units, wherein the body portion of said displacement member has a thickness thereof decreasing stepwise in a direction from the proximal end toward said percussion units.

4. A keyboard-type tone plate percussion instrument, comprising:

a plurality of keys that constitute a keyboard;

a plurality of tone plates each of which sounds a musical tone of a specific tone pitch when struck;

a plurality of percussion units that are disposed so as to correspond to respective ones of the plurality of keys and the plurality of tone plates and are each driven in response to a corresponding key depression operation;

a displacement member alters a tone color of a tone plate disposed for displacement between an intervening position where it is interposed between the tone plates and the percussion units and a non-intervening position where it is extracted from between the tone plates and the percussion units, the displacement member being different in material and hardness from the percussion units; and an operating device for being operated to displace the displacement member, wherein each percussion unit directly strikes a corresponding tone plate when driven with the displacement member extracted from between the tone plates and the percussion units, and indirectly strikes the corresponding tone plate via the displacement member thereby altering the tone color of the struck tone plate when driven with the displacement member interposed between the tone plates and the percussion units, wherein said displacement member includes a proximal end thereof coupled to said operating device and a body portion thereof extending from said proximal end toward said percussion units, wherein the body portion of said displacement member has a thickness thereof gradually decreasing in a direction from the proximal end toward said percussion units.

* * * * *